United States Patent [19]

Zedrosser

[11] Patent Number: 4,944,109

[45] Date of Patent: Jul. 31, 1990

[54] RIFLE

[75] Inventor: Ulrich Zedrosser, Steyr, Austria

[73] Assignee: Steyr-Daimler-Puch AG, Vienna, Austria

[21] Appl. No.: 404,079

[22] Filed: Sep. 7, 1989

[30] Foreign Application Priority Data

Sep. 23, 1988 [AT] Austria ..... 2353/88

[51] Int. Cl.[5] ..... F41C 23/00

[52] U.S. Cl. ..... 42/71.01; 42/75.01

[58] Field of Search ..... 42/71.01, 75.01, 75.02, 42/75.03

[56] References Cited

U.S. PATENT DOCUMENTS 3,512,290 5/1970 La Violette et al. .
3,939,589 2/1976 Tellie .
4,562,659 1/1986 Neta .

FOREIGN PATENT DOCUMENTS 325463 10/1975 Austria .
328336 3/1976 Austria .

*Primary Examiner*—Charles T. Jordan
*Assistant Examiner*—Richard W. Wendtland
*Attorney, Agent, or Firm*—Marmorek, Guttman & Rubenstein

[57] ABSTRACT

A rifle comprises a receiver, a firing mechanism mounted in the receiver, a barrel which is detachably connected to the receiver, and a stock, which is detachably secured to the receiver by built-in catches or the like and covers the receiver and the barrel at least in part and is provided with a trigger mechanism and a magazine holder. In order to provide an effective guard for the rifle, to reduce the overall length of the rifle and to provide a simpler stock, the stock consists of two parts, namely, a butt part, which is provided with the magazine holder, and a front part, which is provided with the trigger mechanism, the interface between said two parts of the stock comprises an intermediate portion, which extends on both sides of the stock approximately in the longitudinal direction of the butt part, the front part is slidably fitted on the front portion of the receiver and is forwardly removable therefrom, the butt part is slidably fitted on the rear portion of the receiver and is rearwardly removable therefrom, and one of said parts of the stock is provided on opposite sides of said stock at said interface with edge flanges which overlap the other of said parts.

5 Claims, 1 Drawing Sheet

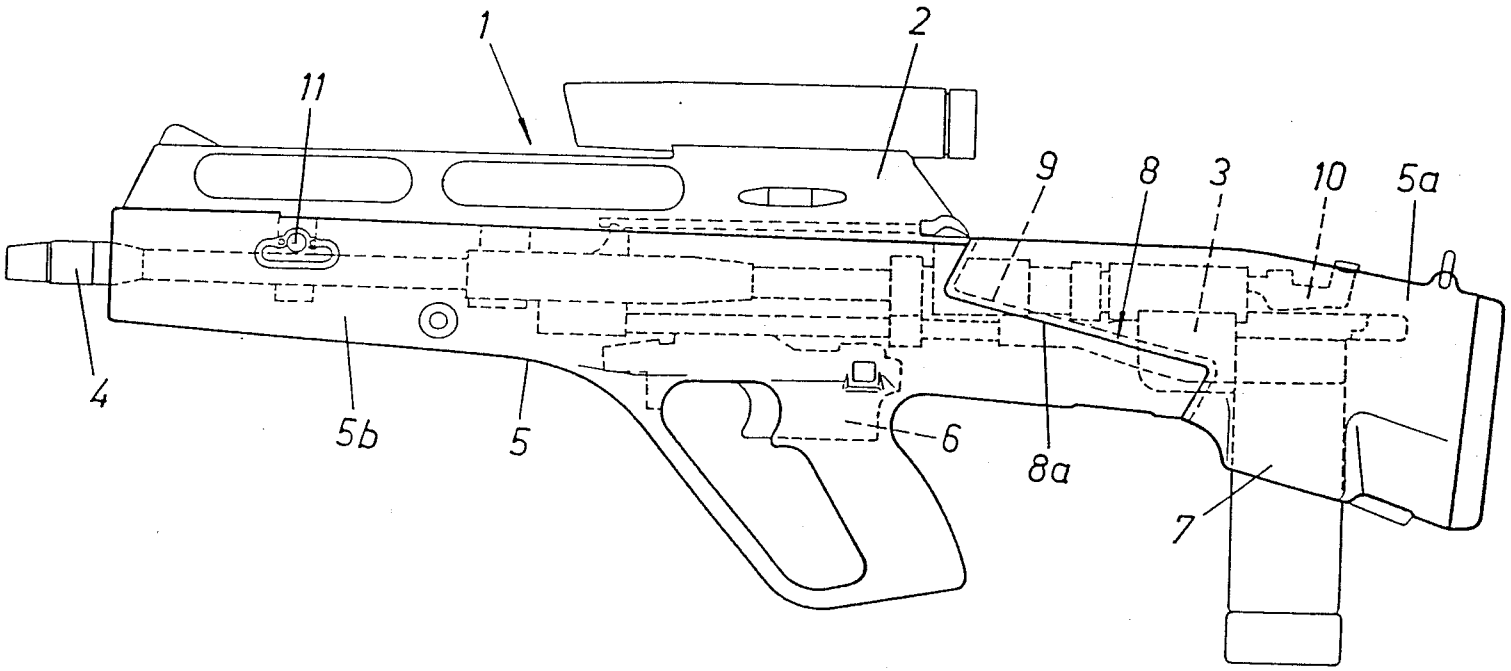
5a
10
3
8
9
2
1
11
4
5b
5
6
8a
7

RIFLE

BACKGROUND OF THE INVENTION

1. Field of the Invention

This invention relates to a rifle comprising a receiver, a firing mechanism mounted in the receiver, a barrel, which is detachably connected to the receiver, and a stock, which is detachably secured to the receiver by built-in catches or the like and covers the receiver and the barrel at least in part and is provided with a trigger mechanism and a magazine holder.

2. Description of the Prior Art

Such rifles have been disclosed, e.g., in Austrian Patent Specification 325,463 and in most cases constitute automatic rifles and have proved satisfactory because they are composed of individual units, which can conveniently be handled and consist of the receiver provided with the firing mechanism, the stock provided with the trigger mechanism and the magazine holder, and the barrel so that the rifle can relatively easily be taken apart into said units without a need for tools and loose parts other than said units will not be obtained by such disassembly. In the known rifles of that kind, the stock is made in one piece and the receiver is slidably inserted into said stock, which is expensive because it must specially be designed to permit such slidable insertion of the receiver into the stock. That specially designed stock adds to the overall length of the rifle and can cover only the rear portion of the rifle so that the stock can perform its desired guarding function only on that rear portion of the rifle.

U.S. Pat. No. 3,512,290 discloses a rifle having a tripartite stock, a barrel, which is permanently connected to the receiver, and a tubular magazine, which is permanently mounted on the receiver. The stock comprises a butt part, which has an opening through which the magazine can be loaded, a top part, which carries the sight, and a bottom part, which is provided with the trigger mechanism. Said three parts of the stock are connected along their interfaces by key-groove joints and are connected to each other and to the receiver by separate coupling members between the piston part and the top and bottom parts, an end cap fitted on the top and bottom parts, a shoulder rest for the piston part, and associated fixing screws. Whereas that tripartite stock covers the firearm to a large extent, its manufacture is rather expensive, it can be taken apart and assembled only by complicated operations, for which tools are required, and it comprises loose parts, which can easily be lost.

SUMMARY OF THE INVENTION

For this reason it is an object of the invention to eliminate the disadvantages outlined hereinbefore and to provide a rifle which is of the kind described first hereinbefore and comprises a stock which is simple, can conveniently be handled and covers the firearm to the largest possible extent whereas the firearm has a relatively short length.

That object is accomplished in accordance with the invention in that the stock consists of two parts, namely, a butt part, which is provided with the magazine holder, and a front part, which is provided with the trigger mechanism, the interface between said two parts of the stock comprises an intermediate portion, which extends on both sides of the stock approximately in the longitudinal direction of the butt part, the front part is slidably fitted on the front portion of the receiver and is forwardly removable therefrom, the butt part is slidably fitted on the rear portion of the receiver and is rearwardly removable therefrom, and one of said parts of the stock is provided on opposite sides of said stock at said interface with edge flanges which overlap the other of said parts. That bipartite stock can cover the rifle to a large extent and has a simple shape and its parts can quickly and conveniently be mounted on and removed from the receiver. The parts of the stock can well be adapted to the design of the receiver so that there will be no dead spaces within the stock and the rifle may be designed to have a relatively short overall length. Owing to the overlap, the parts of the stock support each other at the interface and even if the locking means are simple the stock will constitute a stable and strong enclosure of the rifle. The parts of the stock overlap in a large length along the interface and that overlap results in a higher mutual stabilization of the parts of the stock and in a stiffening of the stock. Besides, when it is desired to take the rifle apart the parts of the stock will be removed first and this will necessarily have the result that a magazine, which may still be fitted, and the trigger mechanism will be separated together with the stock parts from the firing mechanism and will be removed so that the risk of accidents due to a careless taking apart of the rifle will be minized.

A particularly fast and convenient handling will be permitted if the butt part is locked to the receiver by a catch and the front part is locked to the receiver by a locking pin, preferably by a sling swivel pin. The catch can be unlocked in a simple manner and this will permit a removal of the butt part. When the locking pin has been pulled out, the front part of the stock can be pulled off to expose the receiver. The two parts of the stock need not be locked to each other because their latching to the receiver and their mutual overlap will be sufficient to hold them in position.

BRIEF DESCRIPTION OF THE DRAWING

The drawing is a diagrammatic side elevation showing by way of example a rifle which embodies the invention.

DETAILED DESCRIPTION OF THE PREFERRED EMBODIMENT

The rifle 1 which is shown essentially comprises a receiver 2, which accommodates a firing mechanism 3, a barrel 4, which is detachably connected to the receiver 2, and a stock 5, which covers the receiver 2 and the barrel 4 to a large extent and is provided with a trigger mechanism 6 and a magazine holder 7. The stock 5 is transversely divided into two parts, namely a rear butt part 5*a*, which is provided with a magazine holder 7, and a front part 5*a*, which is provided with the trigger mechanism 6. One of the parts consisting of the butt part 5*a* and the front part 5*b* is provided on opposite sides of the stock 5 with edge flanges 9, which overlap the other of said parts along an interface 8 between said two parts 5*a* and 5*b*. In order to increase the length of those portions of the interface 8 in which the parts 5*a*, 5*b* overlap on the sides of the stock, said interface 8 comprises an intermediate portion 8*a*, which extends approximately in the longitudinal direction of the butt part 5*a*, so that the interface 8 is approximately Z-shaped in side elevation and the two parts 5*a* and 5*b* of the stock 5 snugly contact each other and support each other at the interface 8 to form a stable joint at which they are held together.

The butt part 5*a* is slidably fitted on the rear portion of the receiver 2 and is rearwardly removable therefrom. For that purpose suitable longitudinal guides, not shown, are formed on the receiver 2 and in the interior of the butt part 5*a*. The front part 5*b* is slidably fitted on the front portion of the receiver 2 and is forwardly removable therefrom. For that purpose, longitudinal guides, not shown, are provided on the receiver 2 and in the interior of the front part 5*b*. The two parts 5*a*, 5*b* of the stock are not directly interlocked. The butt part 5*a* is locked to the receiver 2 by a catch 10 and the front part 5*b* is locked to the receiver 2 by a sling swivel pin 11, which serves as a locking pin.

The stock 5 has a simple shape and provides an optimum guard for the rifle 1. Because the stock 5 consists of two parts, it can conveniently be handled, permits a good utilization of the space which is available and permits the design of a rifle having a short overall length.

I claim:

1. A rifle comprising a receiver having a front portion and a rear portion, a firing mechanism mounted in said receiver, a barrel detachably connected to said receiver, said barrel having a front end and a rear end and defining a longitudinal direction, a two-part stock, which covers said receiver and said barrel at least in part, said stock comprising a front part and a butt part extending along said longitudinal direction with said front part being in front of said butt part, said front part covering said barrel at least in part, locking means detachably connecting said stock to said receiver, a trigger mechanism mounted in said front part of said stock, and a magazine holder mounted in said butt part of said stock, said front part of said stock being slidably fitted on said front portion of said receiver and being forwardly removable from said front portion, said butt part of said stock being slidably fitted on said rear portion of said receiver and being rearwardly removable from said rear portion, each of said front and butt parts being detachably connected to said receiver by part of said locking means, an interface along which said front and butt parts contact each other, said interface comprising an intermediate portion extending on opposite sides of said stock approximately in said longitudinal direction, and one of said front and butt parts being formed on opposite sides of said stock along said interface with edge flanges, which overlap the other of said front and butt parts.

2. The rifle set forth in claim 1, wherein said locking means comprise a catch detachably connecting said butt part to said receiver and a locking pin detachably connecting said front part to said receiver.

3. The rifle set forth in claim 2, wherein said locking pin comprises a sling swivel pin.

4. The rifle set forth in claim 1 wherein said interface is approximately Z-shaped.

5. The rifle set forth in claim 1 wherein said front and butt parts are independently connected to said receiver and not to each other.

* * * * *